United States Patent [19]

Deal et al.

[11] Patent Number: 4,623,820

[45] Date of Patent: Nov. 18, 1986

[54] CRT WITH CARBON-PARTICLE LAYER ON A METALLIZED VIEWING SCREEN

[75] Inventors: Samuel B. Deal, Manheim Township, Lancaster County; Donald W. Bartch, Hellam Township, York County, both of Pa.

[73] Assignee: RCA Corporation, Princeton, N.J.

[21] Appl. No.: 607,596

[22] Filed: May 7, 1984

[51] Int. Cl.[4] ..... H01J 29/10

[52] U.S. Cl. ..... 313/466; 313/473; 427/64

[58] Field of Search ..... 313/461, 466, 473, 474; 427/64

[56] References Cited

U.S. PATENT DOCUMENTS

| | | | |
|---|---|---|---|
| 2,878,411 | 3/1959 | Alvarez | 315/1 |
| 3,703,401 | 11/1972 | Deal et al. | 117/33.5 |
| 3,878,427 | 4/1975 | Godfrey | 313/402 |
| 3,878,428 | 4/1975 | Kuzminski et al. | 313/408 |
| 3,909,524 | 9/1975 | Ohkoshi et al. | 313/473 |
| 4,025,661 | 5/1977 | Moscony et al. | 427/68 |
| 4,379,762 | 4/1983 | Chivoda et al. | 427/64 |
| 4,393,118 | 7/1983 | Marshall et al. | 427/64 |
| 4,425,377 | 1/1984 | Deal et al. | 427/64 |

FOREIGN PATENT DOCUMENTS

| | | |
|---|---|---|
| 1198597 | 7/1970 | United Kingdom . |
| 1359720 | 7/1974 | United Kingdom . |

OTHER PUBLICATIONS

"What CAB-O-SK is", Product brochure, published 1968, pp. 3-6.

"Typical Properties of Ludox Collodial Silicia", Product brochure, published Mar. 1984, p. 2.

*Primary Examiner*—S. Leon Bashore

*Assistant Examiner*—Michael K. Boyer

*Attorney, Agent, or Firm*—Eugene M. Whitacre; Dennis H. Irlbeck; Vincent J. Coughlin, Jr.

[57] ABSTRACT

A CRT comprising a screen support, a luminescent viewing screen on the support, a light-reflective metal layer on the screen, and a particulate layer of carbon particles and preformed silica particles on the metal layer. The particulate layer may be made by spraying a suspension of carbon (amorphous carbon and/or graphite) and silica (less than 0.1-micron size) on the metal layer while it is preheated in the 50° to 75° C. range.

6 Claims, 1 Drawing Figure

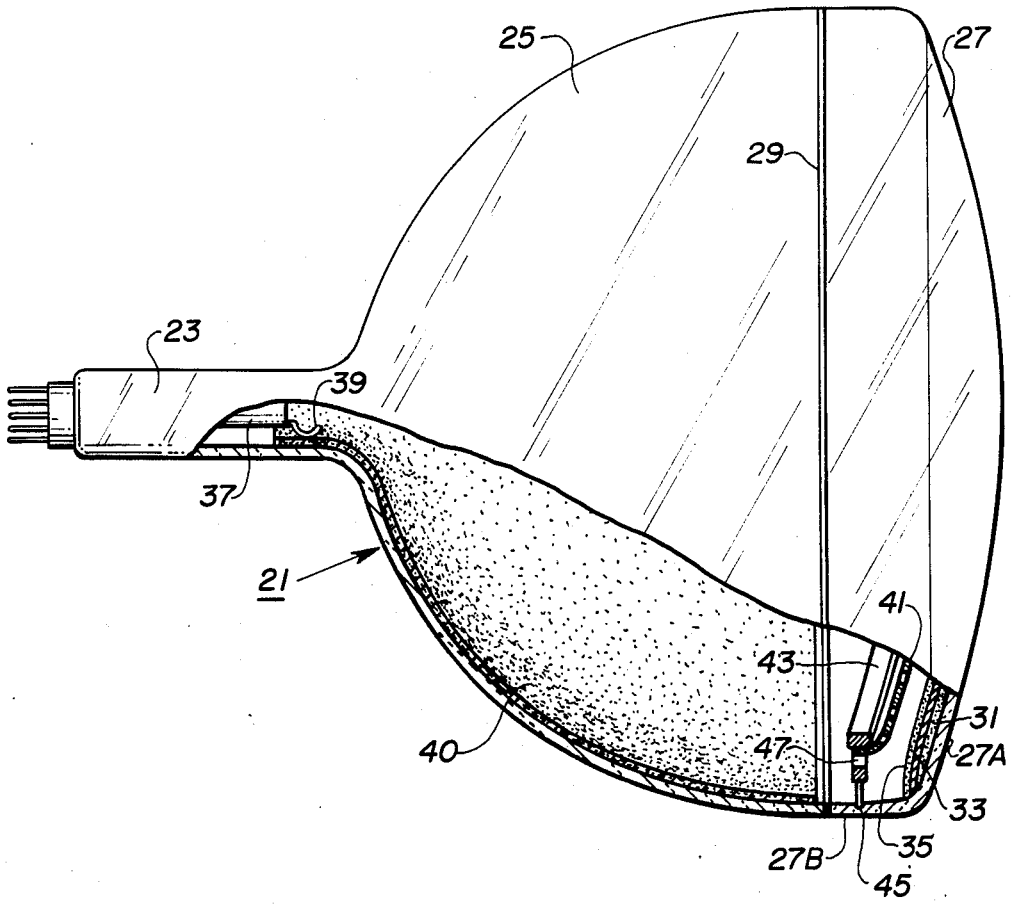
25
27
29
23
39
37
21
41
43
31
27A
40
47
33
35
27B
45

CRT WITH CARBON-PARTICLE LAYER ON A METALLIZED VIEWING SCREEN

BACKGROUND OF THE INVENTION

This invention relates to a novel CRT (cathode-ray tube) having a layer of carbon particles on a metallized viewing screen and to methods of preparation thereof.

U.S. Pat. Nos. 3,703,401 to S. B. Deal et al. and 4,025,661 to J. J. Moscony et al. each disclose a CRT comprising a screen support, a luminescent viewing screen on the support, a light-reflective metal layer on the screen and a carbon-particle layer of amorphous carbon and/or graphite on the metal layer. The carbon-particle layer may absorb heat that is radiated from an associated aperture mask, or may absorb electrons that are scattered from, or generated by, the electron beam or beams that excite the viewing screen. The carbon-particle layer does not include a permanent binder although it is usually made using a temporary organic binder, which is removed during a baking step designed to oxidize or otherwise volatilize organic matter from all of the layers on the screen support.

It has been found that the carbon-particle layer is a source of loose particles after the baking step. After the structure is assembled into an operative CRT, such loose particles can lead to problems of high-voltage stability in the CRT. Thus, it is desirable to include a permanent binder in the carbon-particle layer. The above-cited Moscony et al. patent points out why a metal-ion residue in the carbon-particle layer is undesirable. In addition, any addition to the carbon-particle layer which reduces the luminescent brightness of the screen by more than 5% is undesirable. Thus, the obvious choices of a permanent binder for the carbon-particle layer are unacceptable.

SUMMARY OF THE INVENTION

The novel CRT is similar in structure to the above-described prior CRTs except that the carbon-particle layer contains silica particles as a binder therefor. The preferred silica particles are preformed by pyrolyzing a fumed silicon compound, such as silicon tetrachloride, and have an average particle size of less than 0.1 micron. The silica is a dry powder and is to be distinguished from most silica binders which are gelatinous, and from most preformed silica powders which have much larger average particle sizes.

The novel method is similar to the methods disclosed in the above-cited patents except for the presence of the preformed silica powders, which may be applied before, during or after the carbon particles are applied, preferably by spraying an aqueous suspension thereof. Thus the silica particles may be a layer under the carbon particles, or mixed with the carbon particles in a single layer, or a layer over the carbon particles. In all cases the weight ratio of silica to carbon particles is in the range of 0.9 to 1.1.

BRIEF DESCRIPTION OF THE DRAWING

The sole FIGURE is a partially broken-away longitudinal view of a novel CRT of the invention.

DETAILED DESCRIPTION OF THE PREFERRED EMBODIMENT

The CRT shown in the sole FIGURE is an aperture-mask-type kinescope of the type described in U.S. Pat. No. 3,423,621 to M. R. Royce. The CRT includes an evacuated envelope 21, which includes a neck 23 integral with a funnel 25 and a faceplate panel 27 comprising a viewing window 27A and an integral peripheral sidewall 27B which is joined to the funnel 25 by a seal 29 of devitrified glass. A luminescent viewing screen 31 comprising a mosaic of line or dot areas of different luminescent emission colors resides on the inner surface of the viewing window 27A. A light-reflecting metal layer 33 of aluminum retal resides on the screen 31, and a carbon-particle layer 35 resides on the metal layer 33. An electron-gun mount assembly 37 is located in the neck 23. Three metal fingers 39 space the mount assembly 37 from the neck wall and connect the mount assembly 37 with an internal conductive coating 40 on the inner surface of the funnel 25. Closely spaced from the metal layer 33 is a metal aperture mask 41. The mask 41 is welded to a metal frame 43 which is supported by springs 47 on studs 45 which are integral with the panel 27. An electron beam or beams from the mount assembly 37, when suitably scanned on the screen 31, is capable of producing a luminescent image which may be viewed through the window 27A. Except for the carbon-particle layer 35, the structures and methods of making are described in detail elsewhere and need not be redescribed here.

The carbon-particle layer 35 is about 0.0025 mm (0.1 mil) thick and consists essentially of about equal-weight parts of preformed colloidal silica particles and carbon particles (in the form of amorphous carbon and graphite) per unit area. The carbon-particle layer 35 may be prepared by the following typical procedure, after the aluminum metal layer 33 has been vapor deposited on the screen 31 and before organic matter is removed from the structure. A first suspension has the following formulation:

68.2 grams colloidal graphite such as Aqua Dag E (22% solids) marketed by Acheson Colloids Company, Port Huron, Mich., 15 grams amorphous carbon (average particle size about 0.021 micron), such as Vulcan XC-72 marketed by Cabot Corporation, Boston, Mass., 1.5 grams dispersant, such as Marasperse CBX-2 marketed by Reed Lignin Company, Rothschild, Wisc., 0.3 gram wetting agent, such as Brij 35 marketed by ICI Americas Inc., Wilmington, Del., 1,915 grams deionized or distilled water.

This formulation is mixed in a dispersator for about 15 minutes. The first suspension is then blended for 5 minutes in a dispersator with an equal volume of the following second suspension:

15 grams colloidal silica (average particle size about 0.014 micron), such as Cab-O-Sil M-5 marketed by Cabot Corporation, Boston, Mass., 985 grams deionized or distilled water.

The resultant mixed suspension is ready to be applied to the aluminized screen by spray application.

The panel and intermediate structure thereon are placed in an oven that is preheated to about 85° to 95° C. and kept there for about 15 minutes until the panel is at about the oven temperature. The panel is removed from the oven, and the panel seal lands and the inner sidewalls of the panel including the mask-mounting studs are masked as with a shield to about the mold match line, but leaving the entire viewing area unmasked. Then, with the panel still preheated, an aqueous dispersion of a volatilizable film-forming material is sprayed upon the unmasked aluminum metal layer. A preferred dispersion that is substantially free from substances which, when incinerated, yield metal-ion-containing residues is prepared by mixing 250 milliliters of an aqueous acrylic resin emulsion (containing about 46-weight-percent solids) and 14 grams PVP (polyvinyl pyrolidone) with 2050 milliliters deionized water. A preferred acrylic resin emulsion is Rhoplex AC-234 marketed by Rohm and Haas Company, Philadelphia, Pa., which is believed to be constituted principally of ethyl acrylate copolymerized with minor amounts of acrylic and methacrylic monomers and polymers. The spraying is conducted for about 1 to 3 minutes with an air-spray gun operating at about 50-pounds-per-square-inch pressure, and includes about ten passes of the spray across the surface. The sprayed material dries in less than a minute, due in part to the heat in the preheated panel, forming a sealer coating or barrier layer.

Then, with the panel still preheated above 50° C., and the shield in place, the above-described mixed suspension comprising particles of silica, graphite and carbon black is sprayed upon the unmasked portions of the coated metal layer. The spraying is conducted for about 2 to 5 minutes with an air-spray gun operating at about 50 pounds-per-square-inch pressure and includes about twenty passes of the spray across the surface to provide a coating weight of about 0.15 mg/cm$^2$. The sprayed material dries in less than a minute due in part to the heat in the preheated panel, and forms a heat-absorptive overcoating.

The shield is removed, and the coated panel is now processed in the usual way. This includes the usual step of baking the panel in air at about 400° to 450° C. to remove, by vaporization and oxidation, the volatile and organic matter in the structure. In this last baking step, the film and coating of volatilizable material underlying and overlying the aluminum metal layer, the binders in the mosaic viewing screen, and all of the dispersing agents and wetting agents in the structure are removed. After baking, the structure includes an aluminum-metal reflective layer on the phosphor mosaic viewing screen and a heat-absorptive silica-and-carbon-and-graphite overcoating adhered upon the aluminum layer.

There are many variations that may be made to the above-described example that fall within the scope of the novel method. Many of these variations are disclosed in the above-cited patents to Deal et al. and Moscony et al. and need not be redescribed here.

Either graphite or amorphous carbon or a combination of the two may be used for the carbon in the overcoating. Amorphous carbon may be in the form of lamp black, carbon black or other forms prepared from the incomplete burning of carbon-bearing materials. The graphite may be synthetic or natural. It has been observed that graphite particles are more resistant to oxidation and tend less to penetrate the viewing screen than the amorphous carbon particles. Amorphous carbon particles produce layers that are more heat absorptive and are less resistant to electron penetration. A mixture of the two types of carbon is preferred.

The particle size of the carbon particles is not critical but is preferably colloidal in size to facilitate the preparation and maintenance of a suitable suspension and to minimize electron beam attenuation. The carbon may be suspended in any liquid vehicle that does not adversely affect the phosphor screen. However, it is preferred to disperse the carbon in water. When carbon particles are dispersed in water, it has been found desirable to include wetting and dispersing agents for the purpose of producing a stable suspension. Also, it has been found desirable to omit organic binders for the particles from the suspension. When binders have been included, it has been found that the carbon particles may oxidize excessively during the subsequent baking step, thereby making the process control more difficult.

The particles of silica are preformed and need to be less than 0.1 micron in size with an average size well below 0.1 micron. Suitable silica particles are prepared by pyrolyzing fumed silicon compounds to produce the desired material. A commercially-available family of suitable silicas is marketed by Cabot Corp., Boston, Mass. under the name Cab-O-Sil. Silicas that are made by grinding or precipitation in a wet medium are believed to be unsatisfactory. The silica particles are suspended in a liquid vehicle suitable for air spraying or other methods of application.

The suspension of silica may be mixed with the suspension of carbon particles and deposited on the metal layer as described in the example. The structure produced is designated A in the Table. Alternatively, the silica suspension may be deposited on the metal layer, and then the carbon-particle layer may be deposited on the silica-particle layer. The structure produced is designated B in the Table. Alternatively, the carbon-particle layer may be deposited on the metal layer and then the silica-particle layer deposited on the carbon-particle layer. The structure produced is designated C in the Table. In any of these structures the weight ratio of silica particles to carbon particles per unit area in the finished CRT is about 0.9 to 1.1. It is noteworthy that some of the weight of carbon particles is lost by oxidation during the processing of the CRT.

Relative tests were run on the above-described structures and, as a control, on a similar prior structure having a carbon-particle layer (no silica present) on the metal layer which is designated D in the Table. In the Table, the relative luminescent light output of the viewing screen of each operating CRT was obtained by comparison with the light output from an operating CRT having a noncoated light-reflective metal layer whose light output was considered to be 100%. Relative particle generation was determined by violently pounding the inverted panel and counting the relative numbers of particles released. Relative emissivity is determined by measuring the relative absorption of infrared radiation at the surface of the structure. This data shows that trade-offs can be made by the design of the structure and still be within the teaching of the invention.

TABLE

| | A | B | C | D |
|---|---|---|---|---|
| Light Output % | 97.6 | 93.4 | 98.6 | 97.5 |
| Particle Generation | Good | Best | Poor | Poor |
| Emissivity | 0.62 | 0.68 | 0.59 | 0.60 |

What is claimed is:

1. A cathode-ray tube comprising a screen support, a luminescent viewing screen on said support, said viewing screen having a mosaic of areas of different emission colors, said tube including a metal mask spaced from said screen and having therein an array of apertures in register with areas of said screen, means for exciting said screen to luminescence with at least one electron beam, a light-reflective layer of metal on the back of said screen, and a layer of particles of graphite and/or amorphous carbon on said light-reflective layer, said carbon-particle layer containing in addition preformed silica particles less than 0.1 micron in size as a binder therefor, said silica particles being substantially free from metal-ion containing substances wherein the weight ratio of said carbon particles to silica particles is in the range of 0.9 to 1.1.

2. The tube defined in claim 1 wherein said carbon particles and silica particles are present in a single substantially-uniform mixture.

3. The tube defined in claim 1 wherein said particles are present as a composite of sublayers including a sublayer of carbon particles deposited on said light-reflective layer, and said silica particles are present as a sublayer deposited on said sublayer of carbon particles.

4. The tube defined in claim 1 wherein said particles are present as a composite of sublayers including a sublayer of silica particles deposited on said light-reflective layer, and said carbon particles are present as a sublayer on said sublayer of silica particles.

5. The tube defined in claim 1 wherein said silica is a dry powder produced by pyrolyzing a fumed silicon compound.

6. The tube defined in claim 1 wherein said carbon-particle layer is deposited by spraying an aqueous suspension of said particles on said light-reflective layer with said screen support preheated to temperatures in the range 50° to 75° C.

* * * * *